US009719220B2

(12) United States Patent
Neusch

(10) Patent No.: US 9,719,220 B2
(45) Date of Patent: Aug. 1, 2017

(54) ANTI-RAM GATE

(75) Inventor: William H Neusch, Marble Falls, TX (US)

(73) Assignee: PRAESIDIAD NV, Ghent (BE)

( * ) Notice: Subject to any disclaimer, the term of this patent is extended or adjusted under 35 U.S.C. 154(b) by 1514 days.

(21) Appl. No.: 12/813,457

(22) Filed: Jun. 10, 2010

(65) Prior Publication Data

US 2011/0062402 A1 Mar. 17, 2011

Related U.S. Application Data

(63) Continuation-in-part of application No. 12/057,181, filed on Mar. 27, 2008, now Pat. No. 8,083,433, and a continuation-in-part of application No. 12/534,554, filed on Aug. 3, 2009, now Pat. No. 8,286,950, which is a continuation of application No. 12/048,084, filed on Mar. 13, 2008, now Pat. No. 7,568,679, which is a continuation of application No. 11/175,940, filed on Jul. 6, 2005, now Pat. No. 7,364,137.

(60) Provisional application No. 61/185,930, filed on Jun. 10, 2009, provisional application No. 60/908,391, filed on Mar. 27, 2007.

(51) Int. Cl.
*E01F 15/00* (2006.01)
*E01F 13/12* (2006.01)

(52) U.S. Cl.
CPC ..... *E01F 13/12* (2013.01)

(58) Field of Classification Search
USPC ..... 256/1, 13.1, 73; 404/6, 9–11; 49/9, 131, 49/404, 449
See application file for complete search history.

(56) References Cited

U.S. PATENT DOCUMENTS

| | | | | | |
|---|---|---|---|---|---|
| 1,857,435 | A * | 5/1932 | Cole | 256/13.1 |
| 2,265,698 | A * | 12/1941 | Opgenorth | 256/13.1 |
| RE22,060 | E * | 4/1942 | Hayden et al. | 256/13.1 |
| 2,793,450 | A * | 5/1957 | Williams | 49/30 |
| 2,849,810 | A * | 9/1958 | Voss | 49/271 |
| 3,665,587 | A * | 5/1972 | Michaelsen | 29/461 |
| 4,480,405 | A * | 11/1984 | Ferguson | 49/131 |
| 4,638,597 | A * | 1/1987 | Lybecker | 49/340 |
| 5,039,066 | A * | 8/1991 | Stacey | 256/13.1 |
| 5,118,056 | A * | 6/1992 | Jeanise | 246/127 |
| 5,282,336 | A * | 2/1994 | Tucker | 49/21 |
| 5,332,071 | A * | 7/1994 | Duncan | 188/371 |
| 5,762,443 | A * | 6/1998 | Gelfand et al. | 404/6 |
| 6,065,738 | A * | 5/2000 | Pearce et al. | 256/13.1 |
| 6,131,873 | A * | 10/2000 | Blazon et al. | 248/548 |
| 6,517,280 | B2 * | 2/2003 | Carter | 404/6 |
| 6,840,194 | B2 * | 1/2005 | Young | 119/513 |
| 6,843,613 | B2 * | 1/2005 | Gelfand et al. | 404/6 |
| 6,902,151 | B1 * | 6/2005 | Nilsson | 256/13.1 |
| 2002/0014620 | A1 * | 2/2002 | Nilsson | 256/59 |

(Continued)

*Primary Examiner* — Michael P Ferguson
*Assistant Examiner* — Nahid Amiri
(74) *Attorney, Agent, or Firm* — Symbus Law Group, LLC; Clifford D. Hyra

(57) ABSTRACT

A gate assembly having a cable extending across a panel, the panel movable between a closed position blocking an entry port and an open position; a latch post secured in the ground on a first side of the entry port, wherein a first end of the cable is connected to the latch post when the panel is in the closed position; and a post device secured in the ground on a second side of the entry port, the panel positioned through a passage of the post device.

9 Claims, 6 Drawing Sheets

(56) References Cited

U.S. PATENT DOCUMENTS

| | | | | |
|---|---|---|---|---|
| 2003/0213946 | A1* | 11/2003 | Alberson et al. | 256/13.1 |
| 2003/0222254 | A1* | 12/2003 | Bergendahl | 256/13.1 |
| 2005/0063777 | A1* | 3/2005 | Smith et al. | 404/6 |

* cited by examiner

ANTI-RAM GATE

RELATED APPLICATIONS

This application is a non-provisional patent application claiming the benefit of U.S. Provisional Appl. No. 61/185,930 filed on Jun. 10, 2009.

This application is a continuation-in-part of Ser. No. 12/057,181, filed on Mar. 3, 2008, now U.S. Pat. No. 8,083,433, which is a non-provisional patent application of Ser. No. 60/908,391, filed Mar. 27, 2007, all of which are incorporated herein by reference.

TECHNICAL FIELD

The present invention relates in general to a barrier to vehicular traffic and more specifically to an above grade, vehicular barrier fence and gate to isolate a specified area from unapproved access by vehicles.

BACKGROUND

Vehicle barrier systems are utilized to guard against access to protected areas. In particular, the systems are provided to stop motor vehicles, such as trucks, from being intentionally driven into certain areas for nefarious purposes. At least one agency of the United States Government has provided standards to certify barriers for use. Heretofore, it has commonly been believed that vehicle systems must be so called mass-to-mass systems, wherein the barrier comprises structures of great mass to counteract the mass and kinetic energy of the impacting vehicle.

SUMMARY

According to one or more aspects of the present disclosure a vehicle barrier system for arresting an impacting vehicle of substantial mass within a selected distance of the fence comprises a pair of terminal posts positioned in and secured to the ground in a spaced apart relationship; at least three cables, each cable having opposing terminal ends hingedly connected respectively to each of the terminal posts, the at least three cables held in tension a distance above a grade of the ground and vertically spaced apart from one another in relation to the grade; and a line post secured in the ground and positioned between the pair of terminal posts, the line post holding a portion of each of the cables.

A method according to one or more aspects of the present disclosure for arresting a vehicle of substantial mass from penetrating into a protected area comprises providing a barrier fence, the barrier fence having a pair of terminal posts positioned in and secured to the ground in a spaced apart relationship and a cable having opposing terminal ends connected respectively to each of the terminal posts, the cable held in tension a distance above a grade of the ground between the pair of terminal posts and a gate; impacting a motor vehicle having a substantial mass and moving at a rate of speed into the barrier fence; and stopping penetration of an identified portion of the vehicle from extending a selected distance beyond the cable.

A gate assembly according to one or more aspects of the present disclosure comprises a cable extending across a panel, the panel movable between a closed position blocking an entry port and an open position; a latch post secured in the ground on a first side of the entry port, wherein a first end of the cable connected to the latch post when the panel is in the closed position; and a post device secured in the ground on a second side of the entry port, the panel positioned through a passage of the post device.

The foregoing has outlined some of the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The present disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
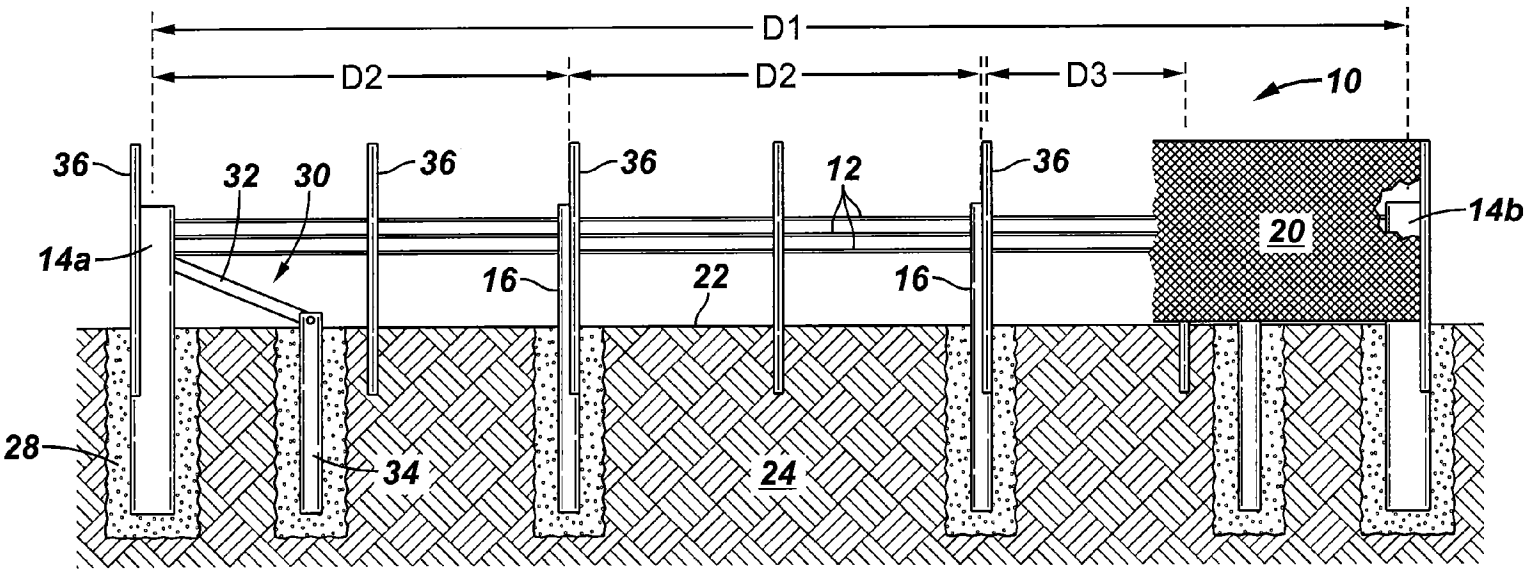
FIG. 1 is an elevation view of an example of a vehicle barrier fence of the present invention.

Refer now to the drawings wherein depicted elements are not necessarily shown to scale and wherein like or similar elements are designated by the same reference numeral through the several views.

Figure 2:
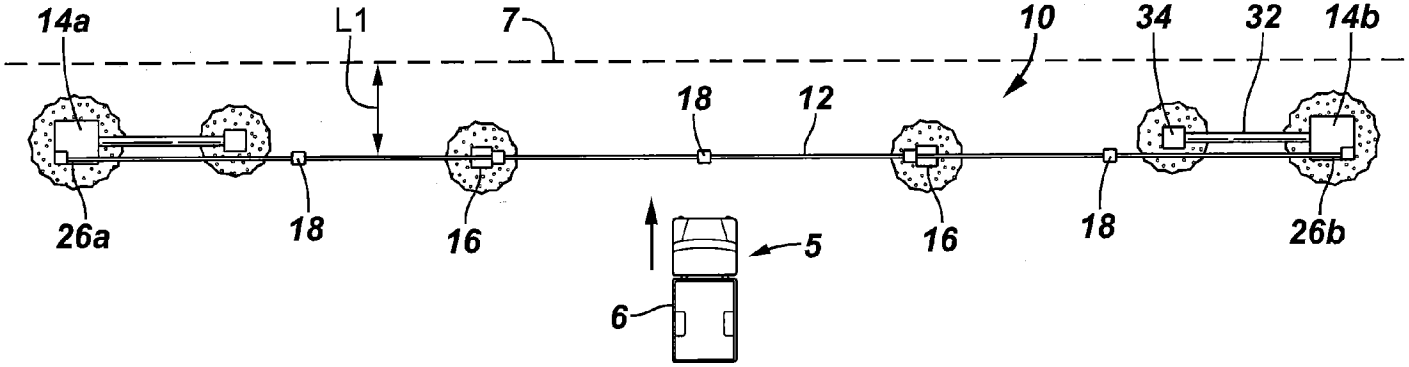
FIG. 2 is a plan view of an example of the vehicle barrier fence of FIG. 1.

FIG. 1 is an elevation view of an example of a vehicle barrier of the present invention generally denoted by the numeral 10. FIG. 2 is a plan view of barrier fence 10 illustrated in FIG. 1. FIG. 2 further illustrates a motor vehicle 6, illustrated as a truck having a bed 6, moving in the direction of the arrow toward barrier fence 10. The hatched line 7 represents a distance L1 of 36 inches from barrier fence 10. In the present example, vehicle 5 has a mass of 15,000 pounds.

The illustrated example is of a longitudinal barrier fence 10, or a portion of a barrier fence. The illustrated and described examples are for a "K12" rated vehicle barrier. K12 refers to a certification class for the United States Department of State. A K12 rating, or certification, requires that the barrier must prevent the bed of a 15,000 pound (6810 kg) truck, traveling at the speed of 50 miles per hour (80 kilometers per hour) from penetrating the barrier more than 36 inches (55 cm) indicated as "L1" in FIG. 2. Barrier fence 10 is also adapted for stopping vehicle 5 within the limits of L1 when traveling 30 miles per hour (48 kph) and 40 mph (65 kph) for obtaining a K4 and a K8 certification respectively. Unexpectedly, a barrier fence corresponding to an example of the present disclosure has been shown to meet the criteria for a K12 certification. Barrier fence 10 is not a mass to mass type barrier that is commonly utilized to achieve the standards necessary for a United States Department of State certification.

Referring to the examples of FIGS. 1 and 2, barrier fence 10 includes cables 12, terminal posts 14, and line posts 16. Barrier fence 10 may further include one or more cable spacing members 18 and/or a security fencing generally denoted by the numeral 20. In FIG. 1, fencing 20 is illustrated as chain link, although other fencing materials including without limitation barb wire, razor wire, wood fencing, and iron. Fencing 10 may be provided to limit or prevent passage of pedestrians, provide an aesthetic covering, or to conceal the vehicle barrier system.

For purposes of brevity and clarity, barrier fence 10 is described herein with reference to a fence or section of fence extending between opposing terminal posts 14. "Terminal" is utilized herein in designating posts to which the terminal end of a cable 14 is connected. Terminal posts 14, as described further below, may be positioned along a longitudinal section or portion of barrier fence 10 or be a corner post. Corner terminal posts are generally utilized for changes of direction in the section of fence. For example, it may be desired to utilize a corner terminal post for a change in direction of cable 12 of greater than about 15 degrees. As will be readily understood, a terminal post 16 may be an "in-line" post wherein the terminal end of a first cable 12 extending a first direction is connected and the terminal end of a second cable 12 that extends a different direction from the first direction (for example 180 degrees) is connected.

Referring now to the example illustrated in FIGS. 1 and 2, three cables 12 extend between opposing terminal posts 14*a*, 14*b*. Cables 12 are vertically spaced apart from one another relative to the grade 22 of ground 24. For example, in FIG. 1 each of the cables 12 are spaced approximately 6 inches (9 cm) from one another and the lowest cable 12 is spaced about 20 inches (30.8 cm) from grade 22.

Each cable 12 has opposing terminal ends 26*a*, 26*b*. Each terminal end 26 is connected to terminal post 14. As will be further described below, terminal end 26 is hingedly connected to terminal post 14 in the Examples of FIGS. 1 and 2. In the illustrated example, terminal posts 14*a* and 14*b* are spaced apart a distance D1. D1 corresponds to the length of cable 12 when it is pulled taught and in position for arresting an impacting motor vehicle. For example, a wire cable 12, having tensile strength of approximately 40,000 pounds (88,000 kg) may span distance D1 when tensioned to about 500 pounds (1,100 kg). In the illustrated example, D1 is no greater than about 2,000 feet (609 m).

Terminal posts 14 are secured into ground 24 by securing means 28. In the illustrated examples, securing means 28 is reinforced concrete. Terminal post 14 may further be secured and stabilized by an anchor mechanism 30. Anchor mechanism 30 may include a cross-member 32 secured between terminal post 14 and an anchor 34 positioned in ground 24. In the illustrated example, anchor 34 is spaced approximately eight feet from terminal post 14 and secured in ground 24 by reinforced concrete. Cross-member 32 is a metal tube.

Figure 7:
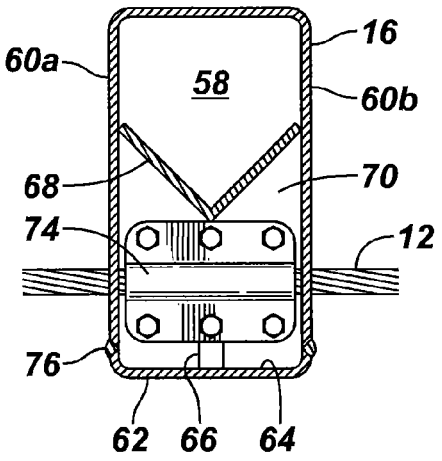
FIG. 7 is a plan view of an example of a line post.
Figure 8:
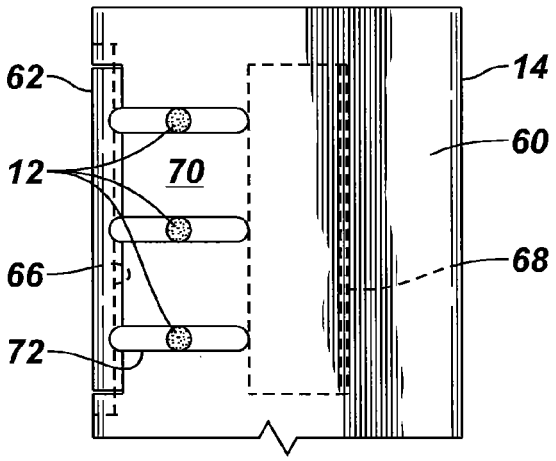
FIG. 8 is an elevation view of a portion of the line post of FIG. 7.

Positioned between terminal posts 14 are one or more line posts 16 which are spaced apart a distance D2. One or more line posts 16, described further with reference to FIGS. 7 and 8, are positioned between terminal posts 14. Line posts 16 are positioned and secured in ground 24 by a securing means 24. Line post 16 is operationally connected to cables 12 in a manner to absorb energy from an impacting vehicle and reduce the force that must be absorbed by terminal posts 14 and the cable to terminal post connections. In the illustrated examples, line posts 16 are spaced from one another no more than about 20 feet (6 m). As will be described further below, cable 12 does not terminate at line posts 16 but is in operational connection to line posts 16.

Cable spacing members 18 are illustrated in FIG. 2 connected to cables 12 and along the span of cables 12. Spacing members 18 tend to maintain cables 12 in a spaced apart relationship when impacted by a vehicle, and therefore maintain contact with the vehicle. Various mechanisms may be utilized to space cables 12 vertically apart, such as but not limited to the example illustrated in FIG. 9. Spacing mechanisms 18 may be independently connected to cables 12 or interconnect cables 12 and a post member.

Figure 9:
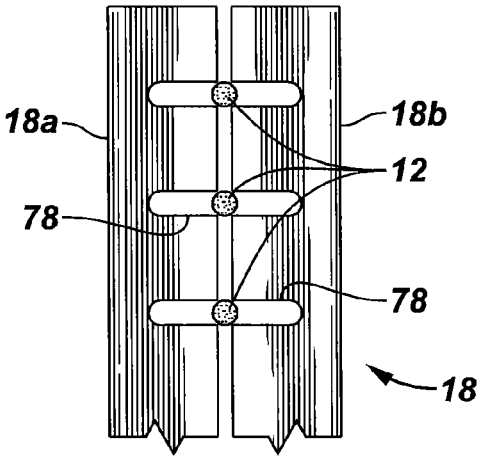
FIG. 9 is an elevation view of an example of a cable spacer mechanism.

For example, with reference to FIG. 1, spacers 18 may be connected to intermediate posts 36. Intermediate posts 36 are, in this example, tubular posts that are positioned into ground 24. Posts 36 are not necessarily secured in ground 24. In the illustrated examples, posts 36 are provided for erecting fencing 20 and provide an additional structure to cooperate with spacing members 18. Spacing members 18 and intermediate posts may be evenly spaced from one another, for example, by the distance D3 which is approximately 10 feet (3 m) in these examples. Cables 12 may be spaced apart, for example, by securing each cable to posts 36 in a spaced apart relationship by a U-bolt or other suitable connector. It is envisioned that a spacing mechanism 18, such as illustrated in FIG. 9, that is solely connected to cables 12 may facilitate the maintenance of the desired spacing during impact by a vehicle.

Figure 3:
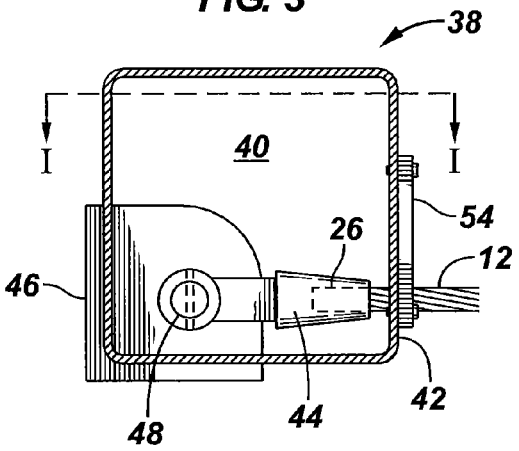
FIG. 3 is a plan view of an example of a terminal post.

Refer now to FIG. 3, wherein an example of a terminal post-cable connection, generally denoted by the numeral 38, is shown. First, terminal post 14 is a tubular member having an internal cavity 40 and a face portion 42. Face portion 42 is a portion of the wall of tubular post 14 that is facing the direction in which a cable 12 extends, or the portion through which cable 12 extends. In the illustrated examples, post 14 is illustrated as a square or rectangular member, although other geometric shapes may be utilized. For example, terminal post 14 may be circular or triangular as well.

In the example of FIG. 3, a terminal post-cable connector 38 includes a spelter socket 44 and plate 46. In this example, terminal end 26 is connected within spelter socket 44, for example with zinc or an epoxy resin, and hingedly connected to plate 46 by pin or shaft 48. Plate 46 is connected to the body of terminal post 14 with cable 12 extending outward from face portion 42. In the illustrated example, spelter socket 44 and terminal end 26 are substantially positioned in cavity 40.

Figure 4:
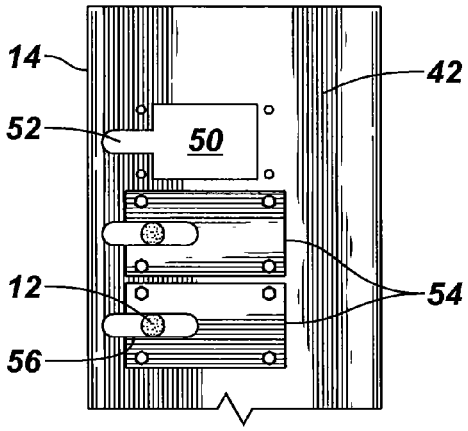
FIG. 4 is an elevation view of an example of a portion of a terminal post.

Refer now to FIG. 4, wherein a face portion 42 of a terminal post 24 is illustrated having a slot 56 for passing cable 12. Slot 56 is a transverse slot that is substantially parallel with the grade and perpendicular to the vertical extension of the post from the ground. Face portion 42 in the illustrated example includes a window 50 formed for each cable 12 and cable to post connector. Window 50 is provided as one manner of positioning connection 38 of FIG. 3. An open leg or slot portion 52 is also formed through face portion 42 for positioning a cable 12. A cover 54 is provided for connecting over a portion of window 50 while providing an open slot 56 that includes leg 52. Slot 56, which is formed through face portion 42, provides for transverse or longitudinal movement of cable 12 during impact by a vehicle thereby limiting or avoiding impact of the cable along the physical body forming the slot.

Figure 5:
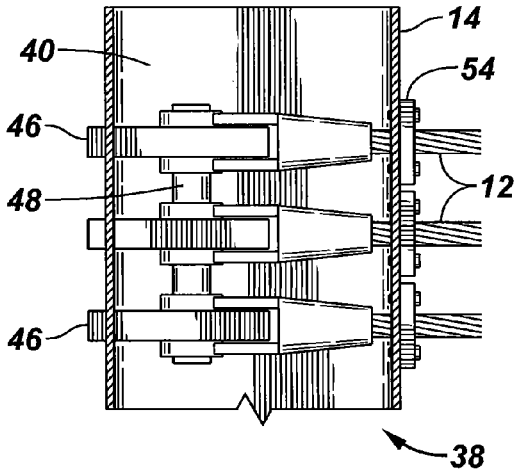
FIG. 5 is a view of a terminal post along the line I-I of FIG. 3.

Refer now to FIG. 5 wherein the terminal-post connection 38 is shown along the line I-I of FIG. 3. This example illustrates that three cables 12 are spaced vertically apart from one another, relative to the ground, and in this example are interconnected by a shaft 48.

Figure 6:
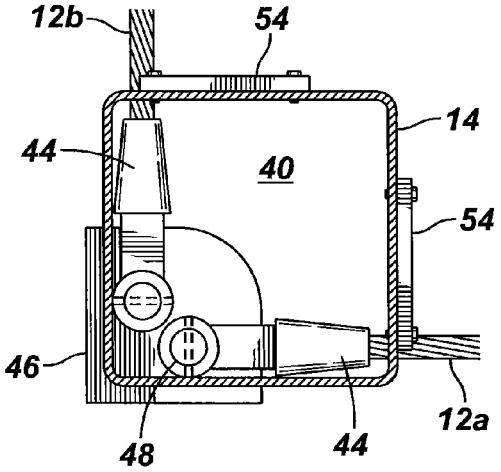
FIG. 6 is a plan view of an example of a corner type terminal post.

FIG. 6 is a plan view of an example of a corner terminal post 14. In this example, cable 12*a* is extending a direction substantially at a right angle to the direction of cable 12*b*. However, cables 12*a* and 12*b* may extend at varying angles from one another.

Refer now to FIGS. 7 and 8 wherein an embodiment of a line post 16 and a line post-cable connection are depicted. Line post 16 is depicted as a tubular post having an internal cavity 58. In this embodiment, line post 16 is a rectangular or square member having opposing sidewalls 60*a* and 60*b* and an interconnecting face plate 62. Face plate 62 includes an interior surface 64 directed into cavity 58. Positioned on interior surface 64 is a spacer member 66. Positioned in cavity 58 is a stop 68 that is spaced apart from spacer member 66 to form a trap 70. Thus, trap 70 is defined between spacer member 66, stop 68, and opposing sidewalls 60*a*, 60*b*. A slot or track 72 (FIG. 8) is formed through each opposing sidewall 60*a*, 60*b* for passing a corresponding cable 12.

Each cable 12 carries a clamping member 74. Clamping member 74 is secured to cable 12 and then positioned in trap 70 so as to be substantially held in place with regard to post 16. It is noted that in this example, face plate 62 is connected between opposing sidewalls 60*a*, 60*b* by a connection means 76 such as welding. Face plate 62 is connected to opposing walls 60*a*, 60*b* after cable 12 and clamps 74 are positioned in cavity 58 and against stop 68. When face plate 62 is connected, cables 12 are positioned within tracks 72. Tracks 72, like terminal post slots 56 (FIG. 4), provide for movement of cable 12 when impacted by a vehicle while mediating damage to cable 12 by contact with the physical structure forming the slots.

Refer now to FIG. 9, wherein an example of a cable spacing mechanism 18 is shown in isolation. In this example, mechanism 18 is an elongated member formed in symmetrical longitudinal sections 18*a* and 18*b*. Each half includes a portion of a cable passage 78. Sections 18*a* and 18*b* are positioned together such that each passage 78 disposes a cable 12. Sections 18*a* and 18*b* may then be interconnected by welding or the like.

Figure 10:
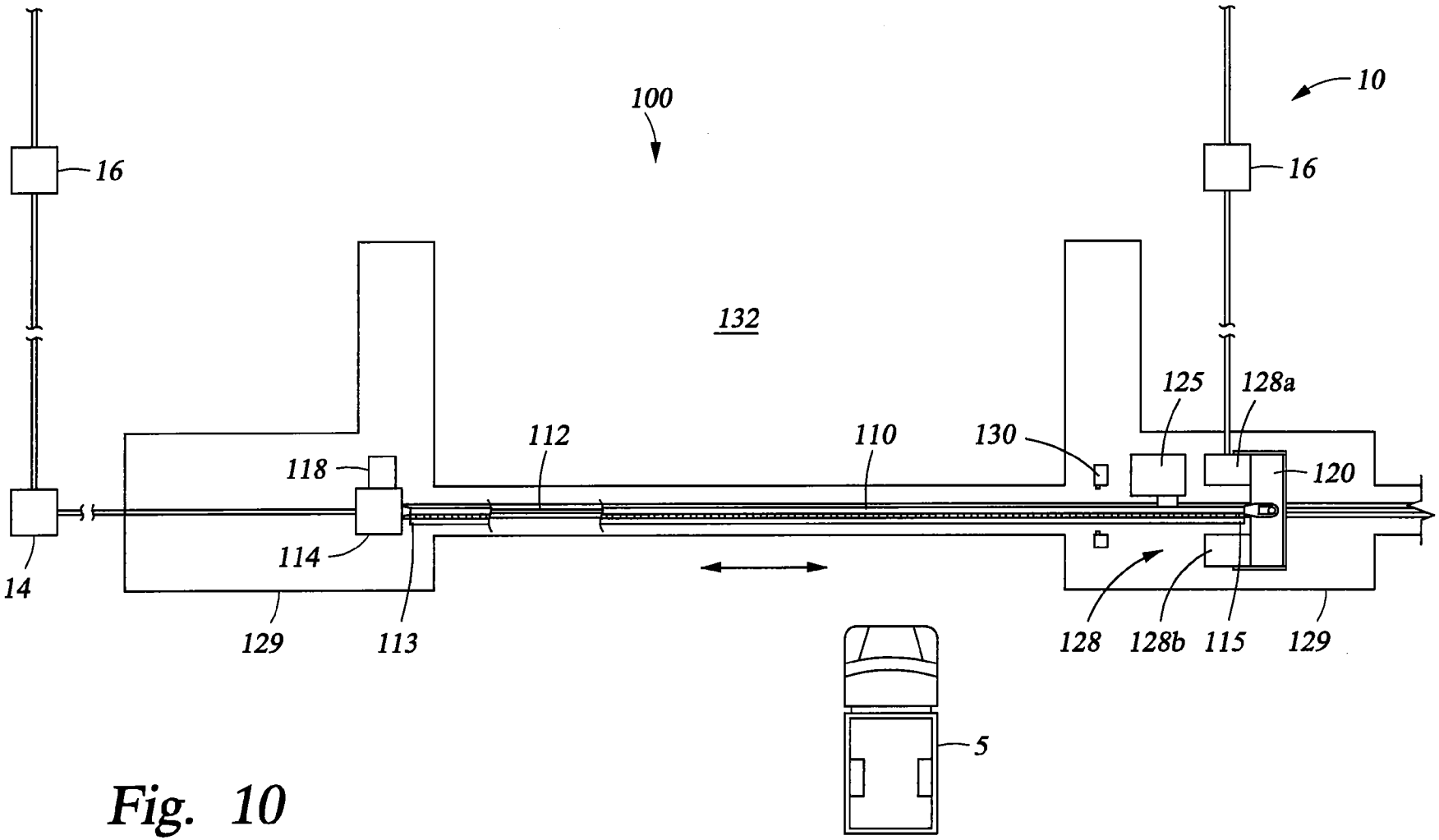
FIG. 10 is a plan view of an example of a gate in accordance with an embodiment of the present disclosure.

FIG. 10 is a plan view of a gate assembly according to one or more aspects of the present disclosure generally denoted by the numeral 100. Assembly 100 comprises a gate 110 (e.g., panel) depicted in the closed position in FIGS. 10 and 11. Panel 110 comprises one or more elongated cables 112 which extend from a first end 113 to a second end 115. In the depicted embodiment, first end 113 is adapted for releasably connecting to latch post 114. Depicted in FIGS. 10 and 11, latch post 114 is immovably secured in the ground 99. Latch post 114 comprises a pin assembly 116 depicted in FIGS. 12A and 12B for releasably securing cables 112 to latch post 114 thereby securing panel 110 in the depicted closed position. An actuator 118, depicted in FIG. 10, may be connected with the pin assembly for operating the pin assembly 11 between the closed position (FIG. 12A) to the open position (FIG. 12B). As will be understood by those skilled in the art with the benefit of the present disclosure, pin assembly 116 may be operated via various mechanical systems and/or manually by an operator. Examples of actuator 118 include, without limitation, fluidic cylinders, electric motors and the like.

Figure 11:
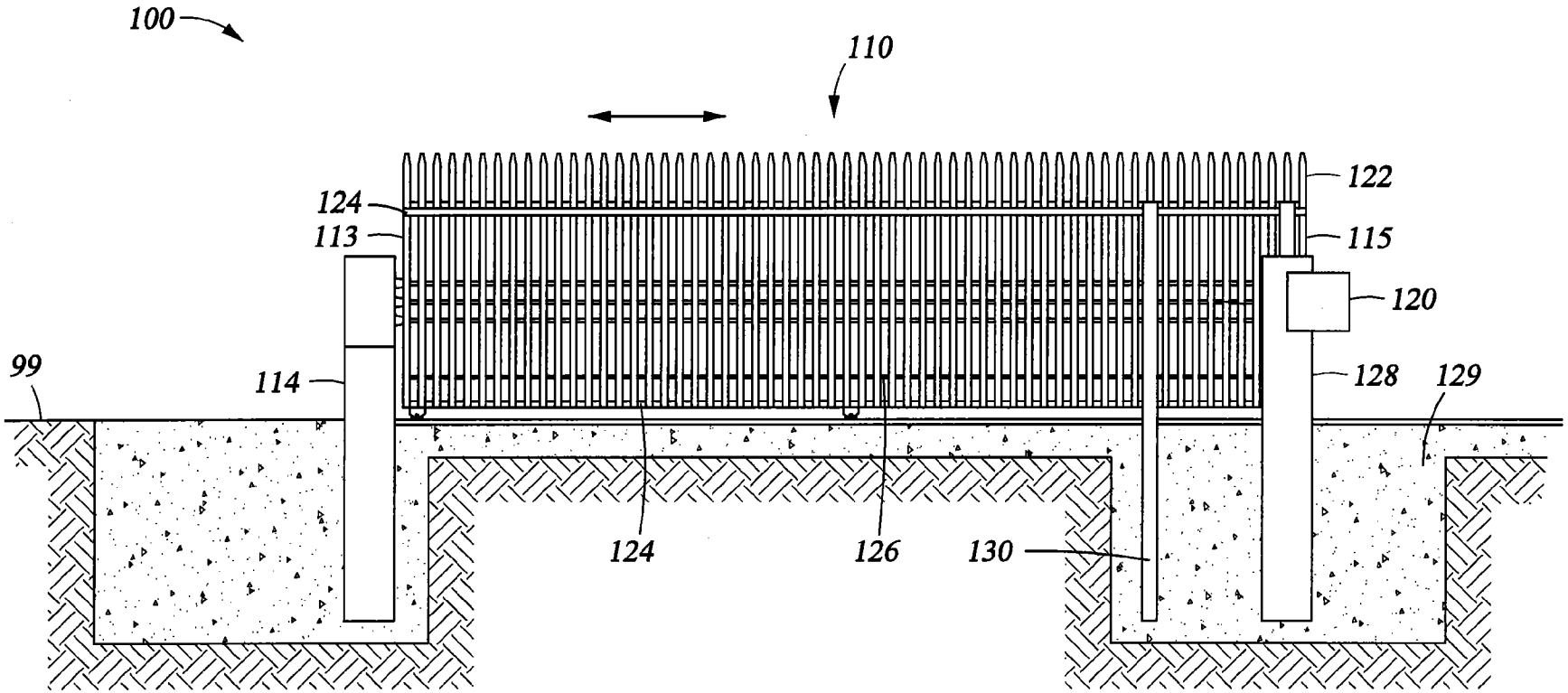
FIG. 11 is an elevation view of an example of a gate in accordance with an embodiment of the present disclosure.

The second end 115 of cables 112 are connected to an end assembly 120, see FIGS. 10, 11, 13A and 13B for example. Panel 110 further comprises two or more vertical members 122 (e.g., pickets). For example, as depicted in FIG. 11, panel 110 comprises a plurality of spaced apart vertically oriented pickets 122 interconnected by at least two horizontally (e.g., laterally) oriented members 124. A moving mechanism 125 (e.g., motor) can be connected to panel 110, for example via chain 126 (FIG. 11) to move panel 110 between the open and closed position.

According to one or more aspects of the present disclosure, end assembly 120 is adapted to engage a post device 128 when panel 110 is in the closed position. Depicted in FIGS. 10 and 11 post device 128 is depicted secured in ground 99, for example by concrete 129. In some embodiments, post device 128 can contain concrete 129. In the depicted embodiment, post device 128 is stationary, thus, end assembly 120 is moved laterally away, for example to the right in FIG. 11, from post device 128 when panel 110 is moved from the closed position as shown in FIGS. 10 and 11.

Figure 14A:
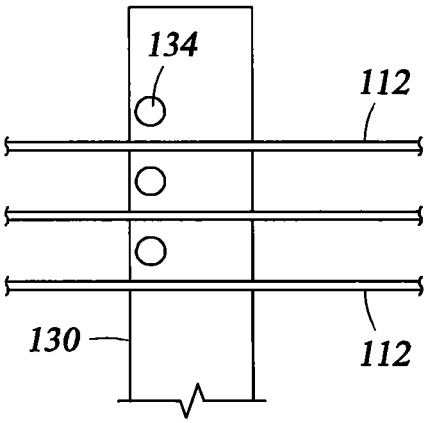
FIGS. 14A, 14B are schematic views of cable spacing according to one or more aspects of the present disclosure.
Figure 14B:
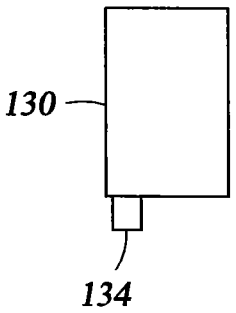

In the depicted embodiment, a support 130 is secured in ground 99, for example by concrete. Support 130 is depicted located between the entry port 132 post device 128 in the embodiment of FIGS. 10 and 11. In FIG. 10 support 130 is shown located on the interior side of panel 110 such that the panel 110 is between support post 130 and a vehicle 5 that is approaching entry port 132 from exterior gated area. Referring to FIGS. 14A and 14B, elements 134 can extend from support post 130 in a manner to space cables 112 from one another.

Figure 12A:
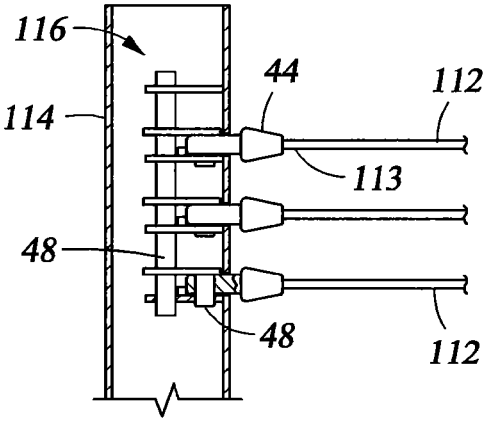
FIG. 12A is a schematic side view of a latch post according to one or more aspects of the present disclosure depicting terminals ends of cables secured to the latch post.
Figure 12B:
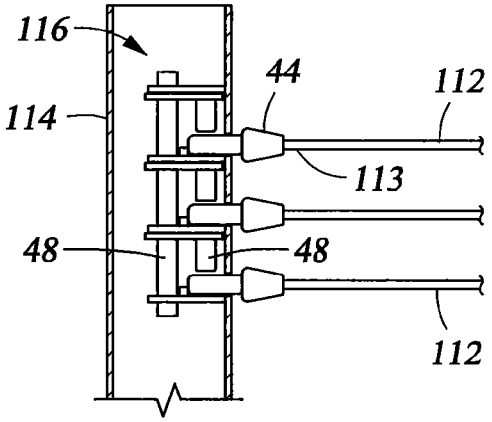
FIG. 12B is a schematic side view of a latch post according to one or more aspects of the present disclosure depicting terminals ends of cables disconnected from the latch post.

Refer now to FIG. 12A wherein the first ends 113 of cables 112 are shown connected and thus secured to latch post 114 and FIG. 12B wherein the first ends 113 of cables 112 are shown disconnected from latch post 114. In the depicted embodiments, connectors 44 (e.g., spelter sockets) a connected to ends 113 of cables 112. Pin assembly 116 is utilized to connect and secure connectors 44 and thus cables 112 to latch post 114.

Figure 13A:
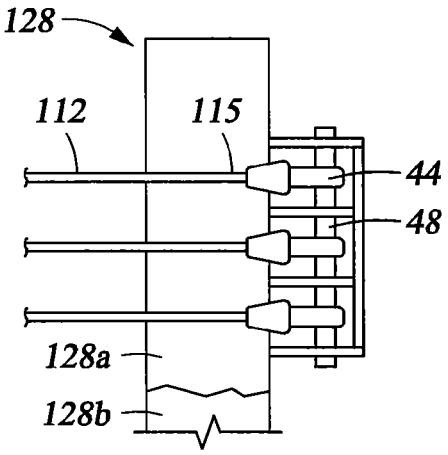
FIGS. 13A, 13B are schematic side and plan views of a post device according to one or more aspects of the present disclosure.
Figure 13B:
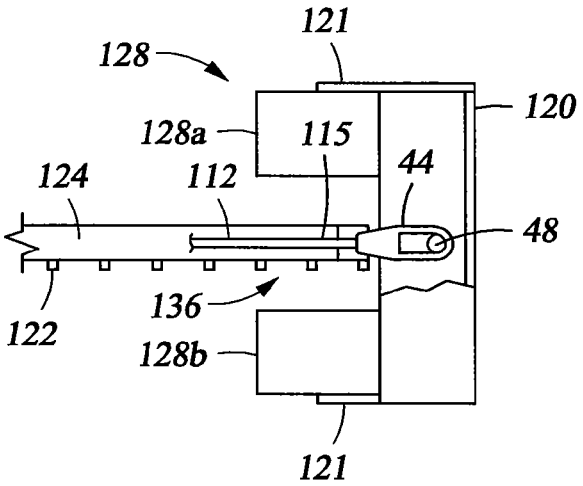

FIG. 13B is a plan view of post device 128 depicting the position of end assembly 120 when panel 110 is in the closed position according to one or more aspects of the present disclosure. Referring in particular to FIGS. 10, 11 and 13B, post device 128 comprises a pair of spaced apart members 128*a*, 128*b* defining a interior passage 136. Passage 136 is adapted to pass panel 110. As clearly depicted in FIG. 13B end assembly 120 can include members 121 for engaging post device 128. In the depicted embodiment, terminal end 115 of cable 112 is depicted connected to end assembly 120 via pin 48. Referring to the schematic side view of FIG. 13A, terminal ends 115 are depicted moveably, for example rotationally or hingedly connected to end assembly 120 and pin 48.

From the foregoing detailed description of specific embodiments of the invention, it should be apparent that a system for preventing or limiting the passage of a vehicle into a secured area that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A gate assembly comprising:

a cable extending across a panel, the panel movable between a closed position blocking an entry port and an open position;

a latch post secured in the ground on a first side of the entry port, a first end of the cable connected to the latch post when the panel is in the closed position; and a post device secured in the ground on a second side of the entry port, the panel positioned through a passage of the post device;

wherein the latch post comprises a pin assembly, the first end of the cable being connected to the pin assembly when the panel is in the closed position.

2. A gate assembly comprising:

a cable extending across a panel, the panel movable between a closed position blocking an entry port and an open position;

a latch post secured in the ground on a first side of the entry port, a first end of the cable connected to the latch post when the panel is in the closed position;

a post device secured in the ground on a second side of the entry port, the panel positioned through a passage of the post device; and an end assembly connected to a second end of the cable, the end assembly located on the opposite side of the post device from the first end of the cable.

3. The gate assembly of claim 2, wherein the latch post comprises a pin assembly, the first end of the cable being connected to the pin assembly when the panel is in the closed position and the first end of the cable being disconnected from the pin assembly when the panel is in the open position.

4. A gate assembly comprising:

a latch post secured in a ground on a first side of an entry port, the latch post comprising a pin assembly;

a post device secured in the ground on a second side of the entry port, the post device forming an interior passage;

a panel moveable through the passage between a closed position blocking the entry port and an open position; and a cable extending across the panel, a first end of the cable connected to the pin assembly when the panel is in the closed position.

5. The gate assembly of claim 4, further comprising an end assembly connected to a second end of the cable, the end assembly being located on the opposite side of the post device from the first end of the cable.

6. The gate assembly of claim 4, wherein the first end of the cable is disconnected from the pin assembly when the panel is in the open position.

7. The gate assembly of claim 6, further comprising an end assembly connected to a second end of the cable, the end assembly being located on the opposite side of the post device from the entry port.

8. A gate assembly comprising:

a latch post secured in a ground on a first side of an entry port, the latch post comprising a pin assembly;

a post device secured in the ground on a second side of the entry port, the post device forming an interior passage;

a panel moveable laterally through the interior passage between a closed position blocking the entry port and an open position; and a cable extending across the panel, a first end of the cable connected to the pin assembly when the panel is in the closed position and the first end of the cable disconnected from the pin assembly when the panel is in the open position.

9. The gate assembly of claim 8, further comprising an end assembly connected to a second end of the cable, the end assembly being located on the opposite side of the post device from the entry port.

* * * * *